US011135579B2

(12) United States Patent
Hammerstad et al.

(10) Patent No.: US 11,135,579 B2
(45) Date of Patent: Oct. 5, 2021

(54) APPARATUS WITH ENCODED MEDIA TO INDICATE DISPENSING LOCATIONS FOR PIPETTE DISPENSER

(71) Applicant: HEWLETT-PACKARD DEVELOPMENT COMPANY, L.P., Houston, TX (US)

(72) Inventors: Diane R. Hammerstad, Corvallis, OR (US); Matthew David Smith, Corvallis, OR (US); Hilary Ely, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 288 days.

(21) Appl. No.: 16/099,478

(22) PCT Filed: Jul. 13, 2016

(86) PCT No.: PCT/US2016/042040
§ 371 (c)(1),
(2) Date: Nov. 7, 2018

(87) PCT Pub. No.: WO2018/013100
PCT Pub. Date: Jan. 18, 2018

(65) Prior Publication Data

US 2019/0143316 A1 May 16, 2019

(51) Int. Cl.

| | |
|---|---|
| ***B01L 3/02*** | (2006.01) |
| ***B01L 3/00*** | (2006.01) |
| ***B01L 9/00*** | (2006.01) |

(52) U.S. Cl.
CPC ..... *B01L 3/0237* (2013.01); *B01L 3/54* (2013.01); *B01L 9/56* (2019.08);
(Continued)

(58) Field of Classification Search
CPC ..... G01N 35/1011; G01N 35/1002; G01N 35/00584; G01N 35/00722;
(Continued)

(56) References Cited

U.S. PATENT DOCUMENTS 4,692,609 A 9/1987 Pettersson
5,465,629 A 11/1995 Waylett
(Continued)

FOREIGN PATENT DOCUMENTS

WO WO-2016081595 A1 5/2016

OTHER PUBLICATIONS

Hile, H., et al., Microbiology Tray and Pipette Tracking as a Proactive Tangible User Interface, May 18, 2016, < https://pdfs.semanticsscholar.org/3839/89710c45af933d59c8d9eab66e05e017a5c0.pdf >.

*Primary Examiner* — Brandi N Hopkins
(74) *Attorney, Agent, or Firm* — Dicke Billig & Czaja PLLC

(57) ABSTRACT

An apparatus includes a media that includes an encoded pattern to indicate a location of each of a plurality of dispensing locations on a receiving area for a pipette dispenser. The encoded pattern is employed to guide the pipette dispenser to dispense a volume to a selected dispensing location from the plurality of dispensing locations based on a predetermined dispensing location on the receiving area.

19 Claims, 4 Drawing Sheets

(52) U.S. Cl.
CPC ... *B01L 2200/143* (2013.01); *B01L 2300/021* (2013.01); *B01L 2300/0627* (2013.01)

(58) Field of Classification Search
CPC ..... G01N 2035/0091; B29C 64/393; B29C 64/295; B29C 64/209; B29C 64/171; B29C 64/118; B29C 64/106; B33Y 30/00; B33Y 50/02; B01L 3/02; B01L 3/527; B01L 3/0237; B01L 2300/027; B01L 2300/0829; B01L 2200/025; B01L 2300/0654; B01L 2200/148; B01L 2200/143
See application file for complete search history.

(56) References Cited

U.S. PATENT DOCUMENTS

| | | | |
|---|---|---|---|
| 2002/0119077 | A1 | 8/2002 | Shumate |
| 2011/0239757 | A1 | 10/2011 | Camenisch et al. |
| 2013/0205920 | A1 | 8/2013 | Tow |
| 2014/0130614 | A1 | 5/2014 | Zeng |
| 2015/0132742 | A1 | 5/2015 | Thuo et al. |
| 2017/0263510 | A1* | 9/2017 | Baba ..... H01L 21/0271 |

* cited by examiner

APPARATUS WITH ENCODED MEDIA TO INDICATE DISPENSING LOCATIONS FOR PIPETTE DISPENSER

BACKGROUND

A pipette is a laboratory tool commonly used in chemistry, biology and medicine to transport a measured volume of liquid, often as a fluid dispenser. Pipettes come in several designs for various purposes with differing levels of accuracy and precision, from single piece glass pipettes to more complex adjustable or electronic pipettes. Many pipette types operate by creating a partial vacuum above the liquid-holding chamber and selectively releasing this vacuum to draw up and dispense liquid, for example. Measurement accuracy varies depending on the style of pipette employed.

DETAILED DESCRIPTION

This disclosure relates to a media that includes an encoded pattern to identify a location of a dispensing location on a receiving area (e.g., well plate, petri dish) that receives a volume distribution from a pipette dispenser. The media can include encoded dot patterns that are illuminated via infrared light (or other wavelength) that is directed from the pipette dispenser where a camera and decoder in the dispenser detects and decodes the illuminated patterns. The decoder and associated processor determine a location the pipette is located with respect to a receiving area having a plurality of dispensing locations. The media can also include a conductive layer (or portion of a layer surrounding locations) in one example that can be sensed from a sensor in the pipette to determine the desired depth of the pipette with respect to a given receiving location before dispensing of the volume (e.g., fluid or other substance such as dry particulates) from the pipette. The media provides a low cost apparatus that facilitates that the correct fluid is dispensed into the correct location via the encoding pattern, where the depth of the pipette into the dispensing location can also be controlled in a low cost manner.

The media can be provided as an overlay that is positioned on top of a dispensing location or the media can be positioned below or integrated within the dispensing location in other examples. The pipette can determine dispensing locations via an infrared (IR) camera on the pipette where a conductive reading from the media can be sensed in the pipette that enables the release of the desired volume (e.g., fluids or particulates) when the proper depth of the pipette with respect to the receiving location has been achieved. Another example to provide the conductive measurement for the depth can be performed using the IR camera to evaluate the size of the dots as the pipette moves toward the encoded pattern. Yet another example to determine depth can utilize an accelerometer in the pipette. The pipette can be operatively coupled to a computing device to receive a dispense profile which informs the pipette of the predetermined locations in which to dispense the given volume. In addition to encoding location, the encoded patterns can indicate other parameters such as the number of drops to dispense at a selected location.

Figure 1:
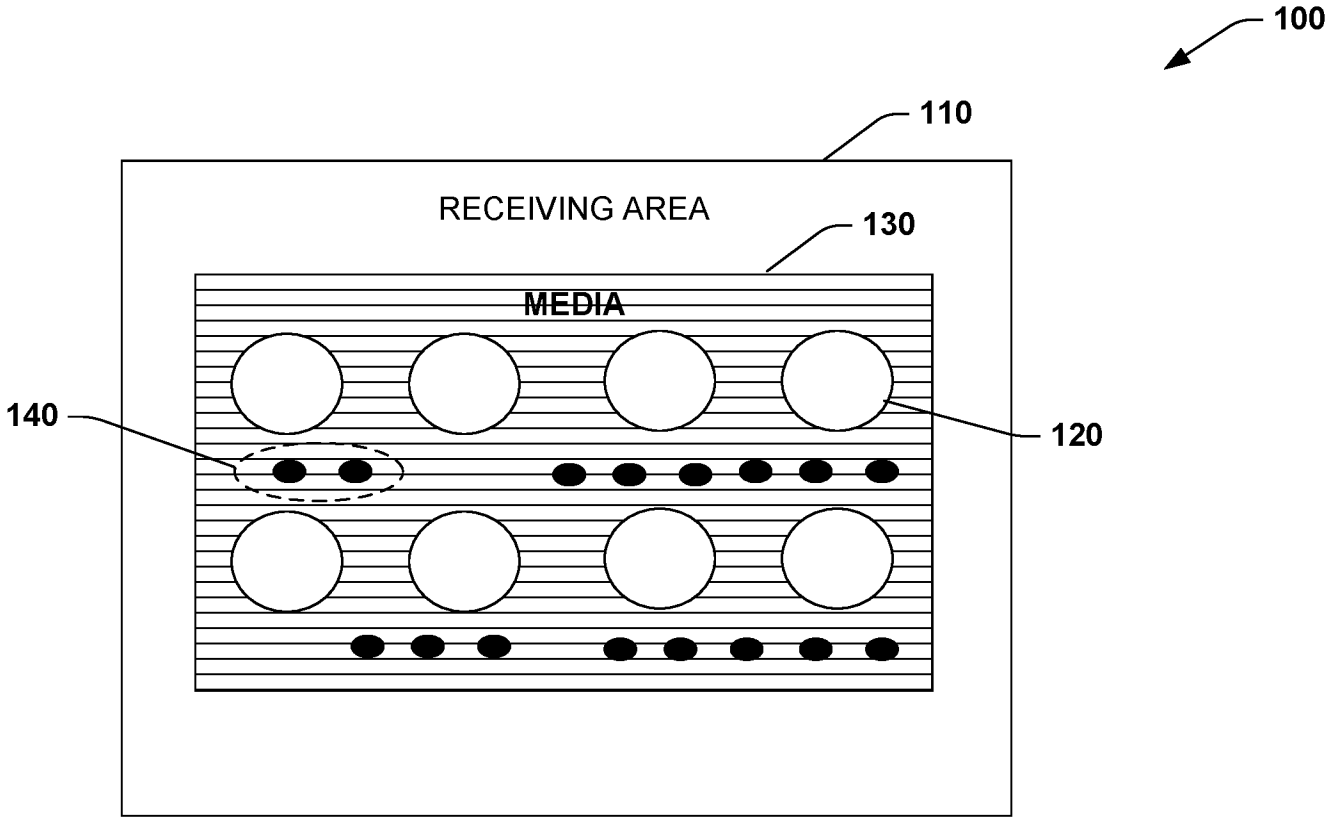
FIG. 1 illustrates an example of an apparatus to provide encoded information to a pipette dispenser.

FIG. 1 illustrates an example of an apparatus 100 to provide encoded information to a pipette dispenser. The apparatus 100 includes a receiving area 110 (e.g., well plate, petri dish) that includes a plurality of dispensing locations 120 to receive a volume from a pipette dispenser. As used herein, the term volume refers to a liquid solution or fine-grained particulate matter that can be dispensed from a given pipette dispenser (See e.g., FIG. 4). A media 130 includes an encoded pattern 140 that illustrates example dot markings of the pattern to indicate a location on the receiving area 110 of each of the plurality of dispensing locations 120. As used herein, the term location refers to an X and Y coordinate on a flat surface where X represents a horizontal coordinate and Y represents a vertical coordinate on the surface. The encoded pattern can be employed to guide the pipette dispenser to dispense the volume to a selected dispensing location 120 based on a predetermined dispensing location on the receiving area 110. For example, selected dispensing locations can be specified via a dispense profile that can be loaded onto the pipette dispenser 110 that provides a number of predetermined dispense locations 120 to be dispensed from the pipette, where the dispense locations are specified as X and Y coordinates which are located via the encoded patterns 140.

The media 130 can be at least one of a paper material, a metallic material, and a plastic material, or combinations thereof for example that includes the encoded pattern 140 to indicate the location on the receiving area 110 of each of the plurality of dispensing locations 120. For example, a thin plastic sheet having encoded dot patterns 140 can be overlaid onto the receiving area 110. In one example, the encoded pattern 140 encodes an X and a Y location for each of the dispensing locations 120 on the receiving area 110. The media 130 can also include a metallic portion to provide a Z direction that indicates a depth with respect to a distance between the pipette dispenser and the receiving area 110 and/or dispensing location 120. Although a top view example is shown in FIG. 1 where the media 130 appears on top of the receiving area 110, in other examples the media 130 can be located beneath the receiving area, or integrated within the receiving area to provide the encoded pattern 140.

The encoded pattern 140 can be illuminated by an infrared source or a visible light source, for example, where reflections (or absorptions) of the radiated energy directed toward the patterns is received at the pipette dispenser to determine location and/or other information encoded thereon. For example, in addition to location information, the encoded pattern 140 can indicate an amount of the volume to dispense to the selected dispensing well 120 (e.g., number of drops to dispense at a given location). Various example aspects of the media 130 and the encoded patterns 140 are described below with respect to FIG. 2.

Figure 2:
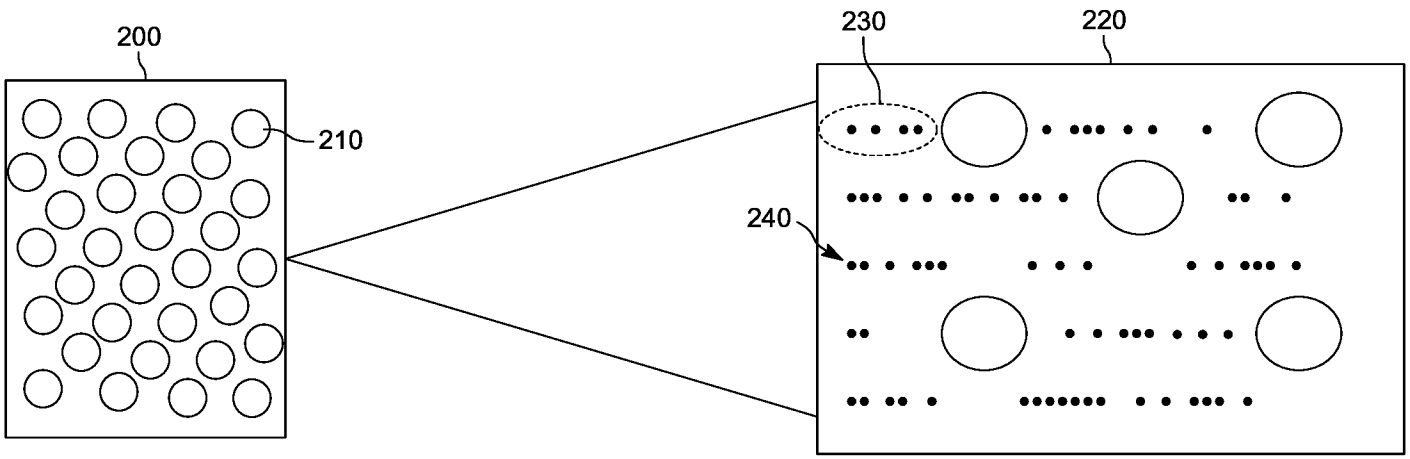
FIG. 2 illustrates an example of a media having an encoded pattern to provide information to a pipette dispenser.

FIG. 2 illustrates an example of a media 200 having an encoded pattern to provide information to a pipette dispenser. In this example, the media 200 is shown as a rectangular material but other shapes are possible (e.g., circular, elliptical, square) depending on the type/shape of receiving area (e.g., well plate, dish) that the media may be coupled/associated with. As shown, a plurality of dispensing holes 210 appear in the media 200 where each of the dispensing holes can be overlaid (or placed underneath) a given receiving area such as a well plate in this example. The holes 210 allow for alignment of the media to the well plate and also allow for the volume to be dispensed from the pipette dispenser through the holes if the media is overlaid onto the well plate. An expanded view of the media 200 is shown at 220. In the view 220 of the media 200, various dot patterns 230 can be observed.

The dot patterns 230 can represent tightly clustered patterns in one example or can be more spaced in other examples. The number of dots in a given area can represent one type of encoding. For example, if three dots were located near a given well followed by a space and then two dots, it can indicate that the X location was the third well from the left on the well plate and the Y location can be represented as the second row where the third well is located. More complex patterns can also be employed. These can include substantially any type of encoding including binary patterns, alpha-numeric patterns based on the ASCII character set, MORSE code patterns, binary coded decimal patterns, and so forth.

In some examples, the dot patterns 230 can be adapted to absorb a given wavelength and in other examples, the dot patterns can be adapted to reflect a given wavelength such as infrared, for example. The dot patterns 230 can be encoded with reflective or transmissive optical qualities, whereas the media 220 where the dot patterns are encoded can be made reflective or transmissive to enhance the reception of the respective dot patterns by creating more contrast between the media and the respective dot patterns.

In an infrared example, the dot patterns 230 can be encoded as position encoded contrast layer that can be disposed on a substrate media 220. The substrate media 220 can be an optically transparent thin film or a layer to reflect non-visible light but can be optically transmissive to visible light. The position encoded contrast layer can include position encoded optical elements represented by the dot patterns 230. A background area shown at example location 240 of the media 220 can be encoded differently for polarized patterns (or non-near-IR absorptive when absorptive dot patterns are employed) from the position encoded optical elements to provide contrast between the optical elements and the background area in response to non-visible light generated from the pipette dispenser. As used herein, the term background area refers to any portion of the media 220 that is not occupied in space by the position encoded optical elements represented by the dot patterns 230. The non-visible light from the pipette dispenser can include infrared (IR) light (e.g., about 750 to 1000 nanometer wavelength), for example.

In one example, the position encoded optical elements represented by the dot patterns 230 can be polarized to a given polarization state (e.g., right hand circularly polarized). The background area 240 can be polarized to a different polarization state from the position encoded optical elements (e.g., left hand circularly polarized), where the difference in polarization states provides contrast in the pattern of light provided from the media 220, which can be utilized to detect spatial location of the pipette dispenser with respect to an area on the well plate. In another example, the position encoded optical elements can be a near-IR absorptive pattern and the background area 240 can be a non near-IR absorptive area so as to provide contrast in the pattern of light provided from the media 220 according to differences in the absorptive optical characteristics between the elements and the background area 240. In each of these examples, the position encoded optical elements and the background area can be optically transparent to visible light. Also, in some examples the position encoded optical elements represented by the dot patterns can be disposed on the front side or back side of the media 220 with respect to the direction of near IR light received from the pipette dispenser.

In some examples, the pipette dispenser (illustrated with respect to FIG. 4 below) includes a strobed infrared light source (e.g., strobed at a respective duty cycle and frequency) to generate the non-visible incident light to the media 220. For example, the non-visible light from the pipette dispenser received can be optically affected (e.g., polarized, reflected or absorbed) by the position encoded contrast layer to generate an output pattern of reflected light that is encoded to indicate location and/or movements of the pipette as it is directed toward the well plate.

By way of example, an optical detector in the pipette, such as a complimentary metallic oxide semiconductor (CMOS) imager or charge coupled device (CCD) imager or sensor (not shown) can then receive the pattern of non-visible light from the media and determine an indication of the pipette's location and/or movement based on the received pattern of light. As disclosed herein, the pattern of non-visible light provided from the media 220 represents a contrast between characteristics implemented by the position encoded optical elements and the background area 240. For example, the position encoded optical element can reflect non-visible light (e.g., near IR light) and the background area 240 can be non-absorptive to the non-visible light where the difference between element absorption and non absorption of the background area 240 encode a spatial pattern.

In yet another example, the media 220 can include different polarized-encoded patterns 230 such that the non-visible light received from the media includes a pattern of different polarization states that encodes spatial information for the pipette. As used herein, spatial information defines a position of the pipette with respect to the well plate such that an image of the encoded pattern can be analyzed by one or more processors in the pipette to determine a location of the pipette in a two dimensional coordinate system (e.g., row/column on the well plate). In such examples, the position encoded optical elements represented by the dot patterns 230 may be patterned as a circular polarized pattern in one direction (e.g., ¼ wavelength retarded) and the background area 240 polarized with a circular polarized pattern in the opposite direction. A polarizer analyzer (not shown) in the pipette can discriminate between the differently (e.g., oppositely) polarized light provided in the non-visible light pattern according to the polarization states of the position encoded optical elements and the background area 240. An example pipette and various decoding and illumination components are described below with respect to FIG. 4.

Figure 3:
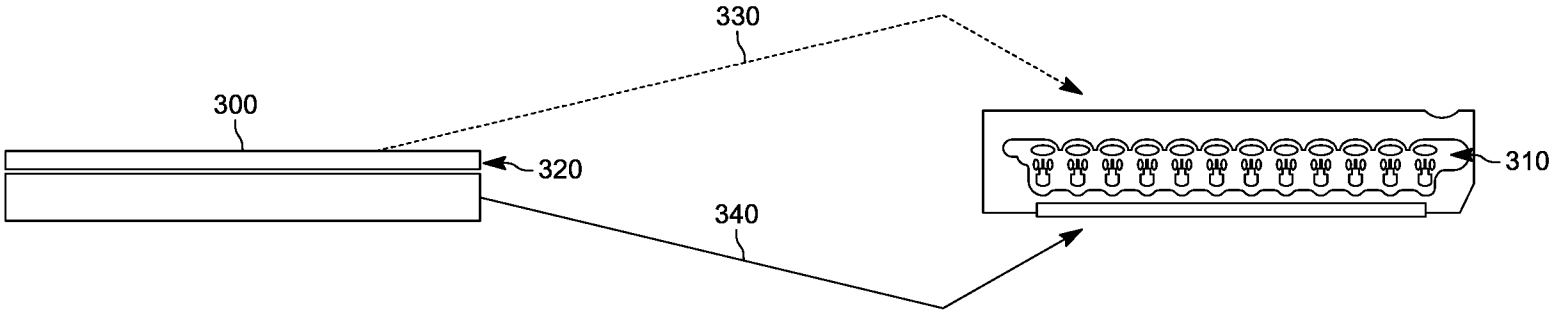
FIG. 3 illustrates an example of a media and placement of the media with respect to a well plate.

FIG. 3 illustrates an example of a media 300 and placement of the media with respect to a well plate 310. As noted previously, other types of receiving areas than well plates can be employed. As described previously, the well plate 310 can include a plurality of dispensing locations to receive a volume from a pipette dispenser. The media includes an encoded pattern (See top view examples in FIGS. 1 and 2 above) to indicate an X and Y location of each of the plurality of dispensing locations on the well plate 310. The encoded pattern can be employed to guide the pipette dispenser to dispense the volume to a selected X and Y dispensing location based on a predetermined dispensing location for the well plate. As noted previously, the predetermined dispensing location (or locations) can be provided via a dispensing profile which can be loaded onto the pipette dispenser from a remote computing device via a wireless communications connection, for example. In this particular example, the media 300 includes a conductive layer 320 to indicate a Z direction with respect to a depth of each of the dispensing wells. The depth can be sensed from the conductive layer 320 to notify the pipette dispenser when to dispense the volume to the predetermined dispensing well.

The media 300 can be located on top of the well plate 310 as shown by location line 330. In another example, the media 300 can be located beneath the well plate 310 as indicated by location line 340. In yet another example, the dot patterns of the media 300 can integrated within the well plate to provide the encoded pattern. For example, dots can be painted or embossed onto the well plate 310 in areas of the well plate not occupied by the dispensing wells.

Figure 4:
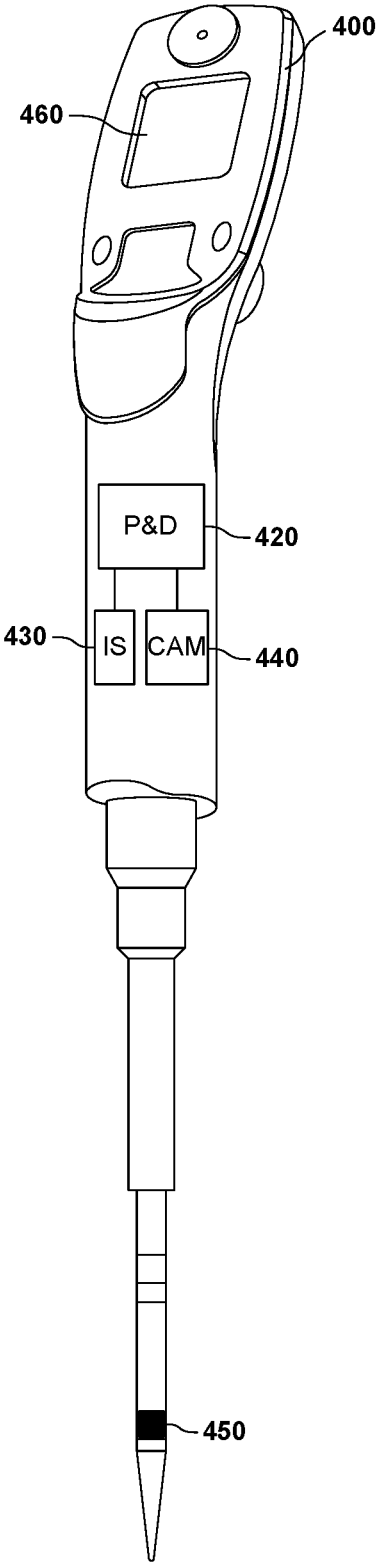
FIG. 4 illustrates an example of a pipette dispenser to receive and process encoded information from a media.

FIG. 4 illustrates an example of a pipette dispenser 400 to receive and process encoded information from a media. The pipette dispenser 400 can be employed to distribute a predetermined volume to a plurality of dispensing wells located on a well plate or other receiving area (See e.g., FIGS. 1 and 3). The pipette dispenser can include mechanical vacuum components to remove a volume from one location and when the vacuum is removed, dispensing of the volume can commence from the pipette at the location specified by the encoded patterns described herein. A button 410 can be provided to enable a user to engage and disengage the vacuum components for dispensing. A decoder shown as P&D (processor and decoder) 420 includes a processor (or processors) for operating the pipette 400 and other pipette components described herein. The processor and decoder 420 can execute instructions from a machine-readable medium such as a memory (not shown). The pipette dispenser 400 receives an encoded pattern from a media that indicates a location of each of the plurality of dispensing locations on the receiving area as previously described. The encoded pattern can be employed to guide the pipette dispenser 400 to dispense the predetermined volume to a selected dispensing location on the receiving area.

The pipette dispenser 400 also includes an illumination source (IS) 430 that includes an infrared source or a visible light source to illuminate the encoded pattern on the media. The pipette dispenser 400 also includes a camera 440 (or sensor) to receive images from the illuminated encoded pattern and provide the images to the decoder 420. In one example, the pipette dispenser 400 can include an impedance sensor 450 (or conductance sensor) to determine a depth from the well plate with respect to the pipette dispenser. The sensor 450 can interact with the embedded conductive layer described herein to determine depth of the pipette before dispensing. As the sensor 450 approaches the conductive layer, a signal can be passed to the processor at 420 to indicate that the desired depth has been achieved. If a conductive layer is not employed for depth sensing, the pipette dispenser 400 can include an accelerometer (not shown) to determine a depth from the well plate with respect to the pipette dispenser based on movement of the pipette dispenser from a predetermined starting position. For example, the user can hit a button indicating a starting location and when the pipette has moved a given distance from the starting point based on accelerometer movement, the depth can be determined.

In yet another example for determined depth, the pipette dispenser 400 can include a processor to determine a depth from the well plate with respect to the pipette dispenser based on an image dot size detected from the encoded pattern. For example, as the pipette 400 moves closer to the well plate, the encoded dots become larger indicating that the pipette is closer to the well plate. Based on the detected size, a depth can be determined. The processor at 420 can execute instructions from a memory not shown. The processor 420 can be a central processing unit (CPU), field programmable gate array (FPGA), or a set of logic blocks that can be defined via a hardware description language such as VHDL. The instructions can be executed out of firmware, random access memory, and/or executed as configured logic blocks, such as via registers and state machines configured in a programmable gate array, for example.

The pipette dispenser 400 can include a display 460 to notify the user when to dispense a given volume at the detected well location. Although a display 460 is shown, other user feedback features can be activated such as audio instructions, vibrations, or other overt means indicating when to dispense at a given well location. When x, y and z measurements satisfy a location to be dispensed, the system can automatically dispense onto the receiving area (e.g., well plate, petri dish). When the dispense volume has been received by the receiving area, the pipette dispenser 400 can prevent another similar volume being dispensed to that portion of the receiving area. For example, there may be two different fluids expected to be dispensed into a single location, and when the two fluids are dispensed, the system can block further dispensing at that location. Thus, controlled dispense can be provided, where if one or more fluids are expected at a given location, and when that location is "satisfied", then no more dispensing is possible until the beginning of a new receiving area, thus to mitigate "double dosing" at any location.

What have been described above are examples. One of ordinary skill in the art will recognize that many further combinations and permutations are possible. Accordingly, this disclosure is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus, comprising:

a media that includes an encoded pattern of markings to indicate a location of each of a plurality of dispensing locations on a receiving area for a pipette dispenser, the encoded pattern is employed to guide the pipette dispenser to dispense a volume to a selected dispensing location from the plurality of dispensing locations based on a predetermined dispensing location on the receiving area, wherein the encoded pattern comprises dot markings and encodes an amount of the volume to be dispensed by the pipette dispenser to the selected dispensing location.

2. The apparatus of claim 1, wherein the media is at least one of a paper material, a metallic material, and a plastic material that includes the encoded pattern.

3. The apparatus of claim 1, wherein the encoded pattern encodes an X and a Y location for each of the dispensing locations on the receiving area.

4. The apparatus of claim 3, wherein the media further comprises a metallic portion to provide a Z direction that indicates a depth with respect to a distance between the pipette dispenser and the receiving area.

5. The apparatus of claim 1, wherein the media is located on top of the receiving area, beneath the receiving area, or integrated within the receiving area to provide the encoded pattern, and wherein the receiving area includes a well plate or a petri dish.

6. The apparatus of claim 1, wherein the encoded pattern is illuminated by at least one of an infrared source and a visible light source.

7. The apparatus of claim 1, wherein the encoded pattern encodes a number of drops to be dispensed by the pipette dispenser to the selected dispensing location.

8. The apparatus of claim 1, wherein the dot markings include position encoded optical elements.

9. The apparatus of claim 1, wherein the dot markings are polarized to a different polarized state relative to a remainder of the media.

10. The apparatus of claim 1, wherein the dot markings are optically transparent to visible light.

11. An apparatus, comprising:

a pipette dispenser to distribute a volume to a plurality of dispensing locations located on a receiving area; and a decoder in the pipette dispenser, the decoder including instructions stored in a machine-readable medium and executable to:

receive an encoded pattern comprising dot markings from a media that indicates a location of each of the plurality of dispensing locations on the receiving area;

decode the encoded pattern to obtain an amount of the volume to be dispensed by the pipette dispenser to a selected dispensing location on the receiving area; and guide the pipette dispenser, using the encoded pattern, to dispense the amount of the volume to the selected dispensing location on the receiving area.

12. The apparatus of claim 11, wherein the pipette dispenser further includes an illumination source to illuminate the encoded pattern, and a camera to receive images from the illuminated encoded pattern and provide the images to the decoder.

13. The apparatus of claim 11, wherein the pipette dispenser further includes an illumination source that includes at least one of an infrared source and a visible light source to illuminate the encoded pattern.

14. The apparatus of claim 11, wherein the pipette dispenser includes an impedance sensor to determine a depth from the receiving area with respect to the pipette dispenser.

15. The apparatus of claim 11, wherein the pipette dispenser includes an accelerometer to determine a depth from the receiving area with respect to the pipette dispenser based on movement of the pipette dispenser from a predetermined starting position.

16. The apparatus of claim 11, wherein the pipette dispenser includes a processor to determine a depth from the receiving area with respect to the pipette dispenser based on an image dot size detected from the encoded pattern.

17. The apparatus of claim 11, wherein the media includes a conductive layer embedded in the media, the apparatus further comprising an impedance senor that is responsive to the conductive layer to determine a depth of the pipette dispense with respect to the selected dispensing location.

18. An apparatus, comprising:

a receiving area that includes a plurality of dispensing locations to receive a volume from a pipette dispenser; and a media that includes:

an encoded pattern to indicate an X and Y location of each of the plurality of dispensing locations on the receiving area, wherein the encoded pattern comprises dot markings and is employed to guide the pipette dispenser to dispense the volume to a selected X and Y dispensing location based on a predetermined dispensing location for the receiving area; and a conductive layer to indicate a Z direction with respect to a depth of each of the dispensing locations, the depth is sensed from the conductive layer to notify the pipette dispenser when to dispense the volume to the predetermined dispensing location.

19. The apparatus of claim 18, wherein the media is located on top of the receiving area, beneath the receiving area, or integrated within the receiving area to provide the encoded pattern.

* * * * *